US010040600B1

(12) United States Patent
Robbins

(10) Patent No.: US 10,040,600 B1
(45) Date of Patent: Aug. 7, 2018

(54) RECONFIGURABLE PALLET WITH INTEGRATED STORAGE COMPARTMENT

(71) Applicant: Jonathan Robbins, Topanga, CA (US)

(72) Inventor: Jonathan Robbins, Topanga, CA (US)

( * ) Notice: Subject to any disclaimer, the term of this patent is extended or adjusted under 35 U.S.C. 154(b) by 0 days.

(21) Appl. No.: 15/881,437

(22) Filed: Jan. 26, 2018

Related U.S. Application Data

(60) Provisional application No. 62/454,261, filed on Feb. 3, 2017.

(51) Int. Cl.

| | |
|---|---|
| ***B65D 19/38*** | (2006.01) |
| ***A63B 71/00*** | (2006.01) |
| ***A63B 71/02*** | (2006.01) |
| ***A63B 63/08*** | (2006.01) |
| ***B65D 19/00*** | (2006.01) |
| *A63B 67/04* | (2006.01) |
| *A63B 63/00* | (2006.01) |

(52) U.S. Cl.
CPC ..... *B65D 19/38* (2013.01); *A63B 63/083* (2013.01); *A63B 71/0036* (2013.01); *A63B 71/023* (2013.01); *B65D 19/0095* (2013.01); *A63B 63/004* (2013.01); *A63B 63/008* (2013.01); *A63B 67/04* (2013.01); *B65D 2519/00029* (2013.01); *B65D 2519/00034* (2013.01); *B65D 2519/00044* (2013.01); *B65D 2519/00064* (2013.01); *B65D 2519/00273* (2013.01); *B65D 2519/00293* (2013.01); *B65D 2519/00323* (2013.01)

(58) Field of Classification Search
CPC ..... A63B 63/004; A63B 63/008; A63B 63/08; A63B 63/083; A63B 67/00; A63B 67/04; A63B 71/00; A63B 71/0036; A63B 71/02; A63B 71/023; B65D 19/00; B65D 19/0095; B65D 19/12; B65D 19/38; B65D 2519/00029; B65D 2519/00034; B65D 2519/00044; B65D 2519/00064; B65D 2519/00273; B65D 2519/00293; B65D 2519/00323
USPC ..... 206/386, 595–600; 473/415–504; 108/50.11–50.18, 51.11–57.34
See application file for complete search history.

(56) References Cited

U.S. PATENT DOCUMENTS

| | | | | |
|---|---|---|---|---|
| 1,504,166 | A | 8/1924 | Thornley | |
| 2,369,944 | A * | 2/1945 | Cahners | B65D 19/0012 108/57.1 |
| 2,468,026 | A | 4/1949 | Boone | |
| 3,207,096 | A | 9/1965 | Munroe | |
| 3,427,025 | A | 2/1969 | Procter | |
| 4,005,902 | A * | 2/1977 | Balin | B60N 2/3011 108/11 |
| 4,373,637 | A | 2/1983 | Shippell | |
| 4,714,026 | A | 12/1987 | Yamaguchi et al. | |
| 4,869,501 | A | 9/1989 | Anastasakis | |
| 4,913,388 | A | 4/1990 | McCant | |
| 4,946,163 | A | 8/1990 | Aakre et al. | |

(Continued)

*Primary Examiner* — Bryon Gehman
(74) *Attorney, Agent, or Firm* — Eric R. Garcia, Esq.; Polsinelli LLP

(57) ABSTRACT

A reconfigurable pallet includes outer panels, a plurality of longitudinal members, a frame, and a compartment disposed within the reconfigurable pallet. The compartment is configured to store components that may be used to disassemble and reassemble the reconfigurable pallet for a different use, purpose or function, including as sporting equipment.

18 Claims, 11 Drawing Sheets

(56) References Cited

U.S. PATENT DOCUMENTS

| | | | |
|---|---|---|---|
| 5,098,092 | A | 3/1992 | Aakre et al. |
| 5,100,132 | A | 3/1992 | Anderson et al. |
| 5,517,927 | A | 5/1996 | Karpisek |
| 5,573,238 | A | 11/1996 | Aaron et al. |
| 5,947,848 | A | 9/1999 | Koole |
| D420,834 | S | 2/2000 | Anderson |
| 6,584,915 | B1 | 7/2003 | Rogers |
| D556,424 | S | 11/2007 | Weise et al. |
| D624,273 | S | 9/2010 | Dong |
| 8,651,492 | B1 | 2/2014 | Cappuccio |
| 2001/0054369 | A1 | 12/2001 | Braley |
| 2003/0040383 | A1 | 2/2003 | Squibb |
| 2005/0255946 | A1 | 11/2005 | Liu |
| 2006/0035732 | A1 | 2/2006 | Tresvant |
| 2006/0254474 | A1 | 11/2006 | Roth et al. |
| 2007/0283857 | A1 | 12/2007 | Dong |
| 2014/0235375 | A1 | 8/2014 | Crosby et al. |

* cited by examiner

RECONFIGURABLE PALLET WITH INTEGRATED STORAGE COMPARTMENT

CROSS REFERENCE TO RELATED APPLICATION

This application claims priority to U.S. Provisional Patent Application No. 62/454,261, filed on Feb. 3, 2017, the content of which is herein incorporated by reference.

TECHNICAL FIELD

The present invention generally relates to shipping pallets, and more particularly to a reconfigurable pallet with an integrated storage compartment.

BACKGROUND

Shipping pallets are conventionally constructed of wood and designed to carry or support packages or freight of varying weights. Shipping pallets also utilize openings adjacent to the ground to allow forks of forklifts or other lifting machinery to lift and manipulate the shipping pallet and accompanying freight. After their useful life, shipping pallets are often discarded or otherwise disposed.

When used to provide aid to areas of need, shipping of pallets and their subsequent loads require careful consideration of weight and space. Areas of need often require food, shelter, water, emergency supplies, medical supplies, and a host of other needs. With limited space and funds, all too often sporting or play equipment for children is omitted. Specifically, sporting equipment, such as basketball poles and backboards or soccer goal posts, are too large and bulky, and costly to ship to areas of need in times of emergency.

SUMMARY

According to various aspects of the subject technology, a reconfigurable pallet is provided that is configured to be disassembled and reassembled, for an entirely different purpose and use. The reconfigurable pallet may be used to ship supplies in a first configuration, and after shipment, may be disassembled and reassembled into sporting equipment such as a basketball pole and backboard, soccer, rugby, hockey, and football goals and/or goal posts, skateboard ramps and obstacles, scooters, cricket wickets, and table tennis tables using only components of the pallet and without compromising or reducing transport capability or capacity.

According to various aspects of the subject technology, a pallet is disclosed. The pallet may include a plurality of interlocking members disposed around a periphery to form a frame. The the frame forms side walls, a top surface, and a bottom surface. The pallet may also include a plurality of longitudinal members arranged along the top and bottom surfaces of the frame; a first internal longitudinal member disposed within the frame that extends across the side walls of the frame; and a second internal longitudinal member disposed within the frame and parallel to the first internal extending member. The pallet further includes an enclosed compartment disposed within the frame. The compartment may be formed from at least one interlocking member of the plurality of interlocking members, at least one longitudinal member of the plurality of longitudinal members, the first internal longitudinal member, and the second internal longitudinal member. In one aspect, the compartment is configured to store components such as disassembly equipment or tools, instruction booklet, sporting equipment such as balls or nets, hardware, or other components necessary for converting the pallet for another use.

According to various aspects of the subject technology, a method for assembling a pallet is provided. The method includes fastening ends of a plurality of interlocking members to form a frame, the frame comprising side walls, a top surface, and a bottom surface; fastening a plurality of longitudinal members along the top and bottom surfaces of the frame; mounting a first internal longitudinal member within the frame, the first internal longitudinal member spanning across the side walls of the frame; mounting a second internal longitudinal member within the frame, the second internal longitudinal member spanning across the side walls of the frame and positioned in parallel with the first internal longitudinal member; forming an enclosed compartment within the frame; and storing components within the compartment.

According to various aspects of the subject technology, a reconfigurable pallet is disclosed. The reconfigurable pallet includes a plurality of interlocking members and a plurality of longitudinal members. In one aspect, when the reconfigurable pallet is in a shipping configuration, the plurality of interlocking members are disposed around a periphery to form the frame, the frame comprising side walls, a top surface, and a bottom surface. Further, when the reconfigurable pallet is in a pallet configuration, the plurality of longitudinal members are arranged along the side walls, top surface, and bottom surface of the frame to form an enclosed compartment within the frame. The compartment may be configured to store components. In another aspect, when the reconfigurable pallet is in a transformed configuration, at least one interlocking member of the plurality of interlocking members is disposed vertically to create a pole and at least one longitudinal member of the plurality of longitudinal members is configured to support the at least one interlocking member of the plurality of interlocking members.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology. The embodiments herein may be better understood by referring to the following description in conjunction with the accompanying drawings in which like reference numerals indicate identical or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology.

Conventionally, shipping pallets are constructed of wood and designed for a single purpose, to carry or support packages or freight of varying weights. Shipping pallets may also have certain features to facilitate transport and movement of shipments, such as openings adjacent to the ground to allow forks of forklifts or other lifting machinery to lift and manipulate the shipping pallet and accompanying freight. After their useful life, shipping pallets are often discarded or otherwise disposed.

Figure 1:
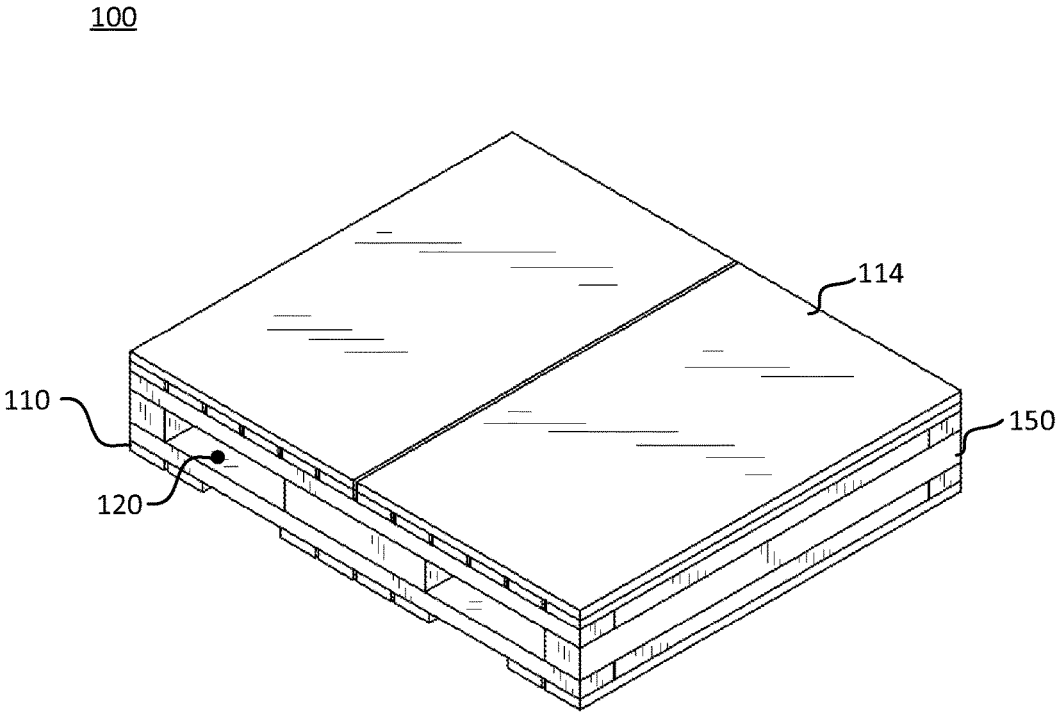
FIG. 1 illustrates a perspective view of a reconfigurable pallet with integrated storage compartment in a shipping configuration, in accordance with various aspects of the subject technology.

FIG. 1 illustrates a perspective view of a reconfigurable pallet 100 with integrated storage compartment assembled in a shipping configuration, in accordance with various aspects of the subject technology. The reconfigurable pallet 100 may comprise members having various widths, lengths and/or thicknesses, that are arranged and assembled to create a platform for stacking, shipping, moving, or otherwise manipulating freight or cargo. In this regard, the reconfigurable pallet 100 may include a plurality of openings 120 that are configured to receive machinery, such as forks of a fork lift, and allow the reconfigurable pallet 100 and accompanying cargo to be moved, stacked, lifted, lowered, or otherwise manipulated. In one aspect, the reconfigurable pallet 100 may comprise one or more outer panels 114, longitudinal members 110, and frame 150.

Figure 2:
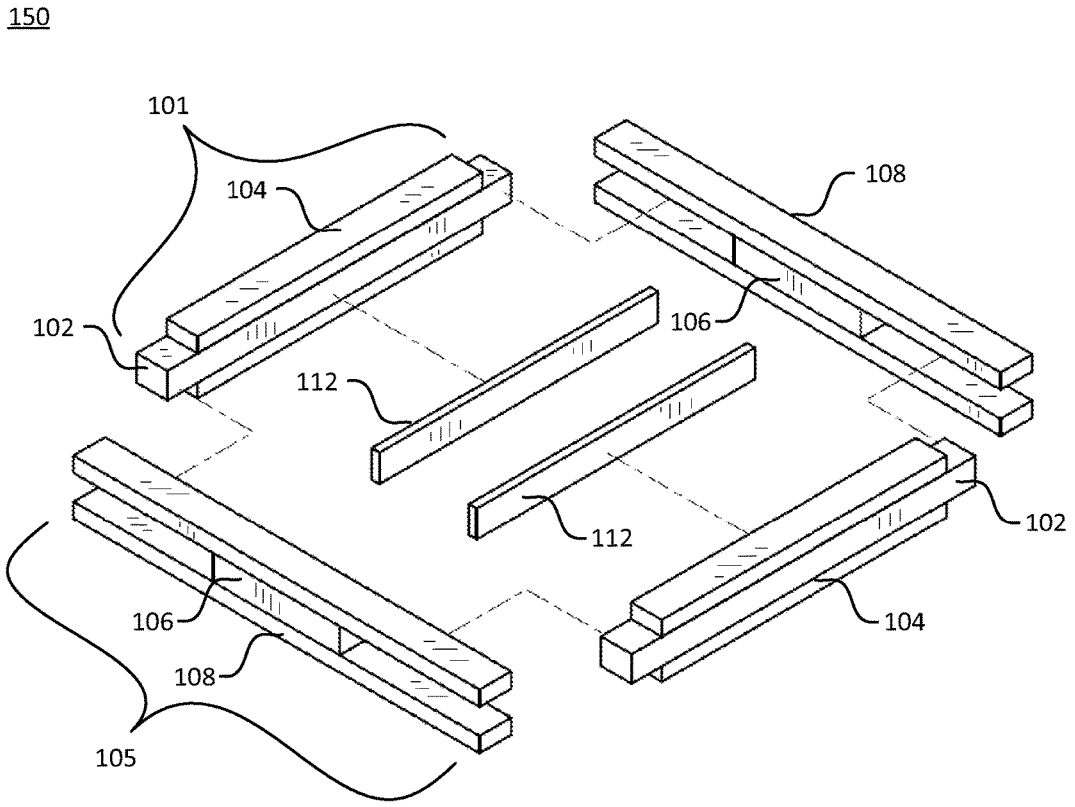
FIG. 2 illustrates an exploded perspective view of a frame of a reconfigurable pallet in a shipping configuration, in accordance with various aspects of the subject technology.

FIG. 2 illustrates an exploded perspective view of a frame 150 of the reconfigurable pallet 100 in a shipping configuration, in accordance with various aspects of the subject technology. In one aspect, the frame 150 may comprise a plurality of interlocking members 101, 105 that are arranged in a rectangular, square or quadrilateral arrangement to form a periphery. The plurality of interlocking members 101, 105 may comprise structural members 102, 106, cladded by outer members 104, 108, with ends that are configured to engage adjacent interlocking members 101, 105.

For example, the plurality of interlocking members 101, 105 may comprise a pair of first interlocking members 101 and a pair of second interlocking members 105. The first interlocking member 101 may comprise a first structural member 102 having a length that is substantially equal to the desired length or width of the reconfigurable pallet 100. Disposed on a top and bottom surface of the first structural member 102, may be first outer members 104 having a length that is less than the length of the first structural member 102. The first outer members 104 may be centered over the first structural member 102 such that ends of the first structural member 102 protrude from ends of the first outer members 104. In one aspect, the length of protrusion of the ends of the first structural member 102 is equal to or more than a width of the first outer member 104.

The second interlocking member 105 may comprise a second structural member 106 having a length that is less than the desired length or width of the reconfigurable pallet 100. Disposed on a top and bottom surface of the second structural member 106, may be second outer members 108 having a length that is substantially equal to the desired length or width of the reconfigurable pallet 100. The second outer members 108 may be centered over the second structural member 106. In one aspect, the protrusion of the ends of the first structural member 102 may be configured to receive ends of the second outer members 108, thereby allowing the interlocking members 101, 105 to engage with each other and form the frame 150. In another aspect, the ends of the first interlocking member 101 may be offset by a predetermined distance. The offset distance of the ends of the first interlocking member 101 may correspond to the width of the second interlocking member 105.

In one example, the first and second structural members 102, 106 may comprise dimensional lumber having a nominal cross section or a thickness and width of about 4 inches by 4 inches. In another example, the first and second outer members 104, 108 may comprise dimensional lumber having a nominal cross section or a thickness and width of about 1 inch by 4 inches. It is understood that the interlocking members 101, 105 may be manufactured from wood, composite, polymer, combination thereof, or other materials as would be known by a person of ordinary skill.

The frame 150 may also comprise internal longitudinal members 112 that are disposed within the frame 150 and surrounded by interlocking members 101, 105. In one example, the frame 150 may comprise a pair of substantially parallel internal longitudinal members 112 that are configured to extend from an internal side wall of the frame 150 to an opposite internal side wall of the frame 150. The internal longitudinal members 112 may comprise dimensional lumber having a nominal cross section or a thickness and width of about 1 inch by 4 inches. It is understood that internal longitudinal members 112 may be manufactured from wood, composite, polymer, combination thereof, or other materials as would be known by a person of ordinary skill.

Figure 3:
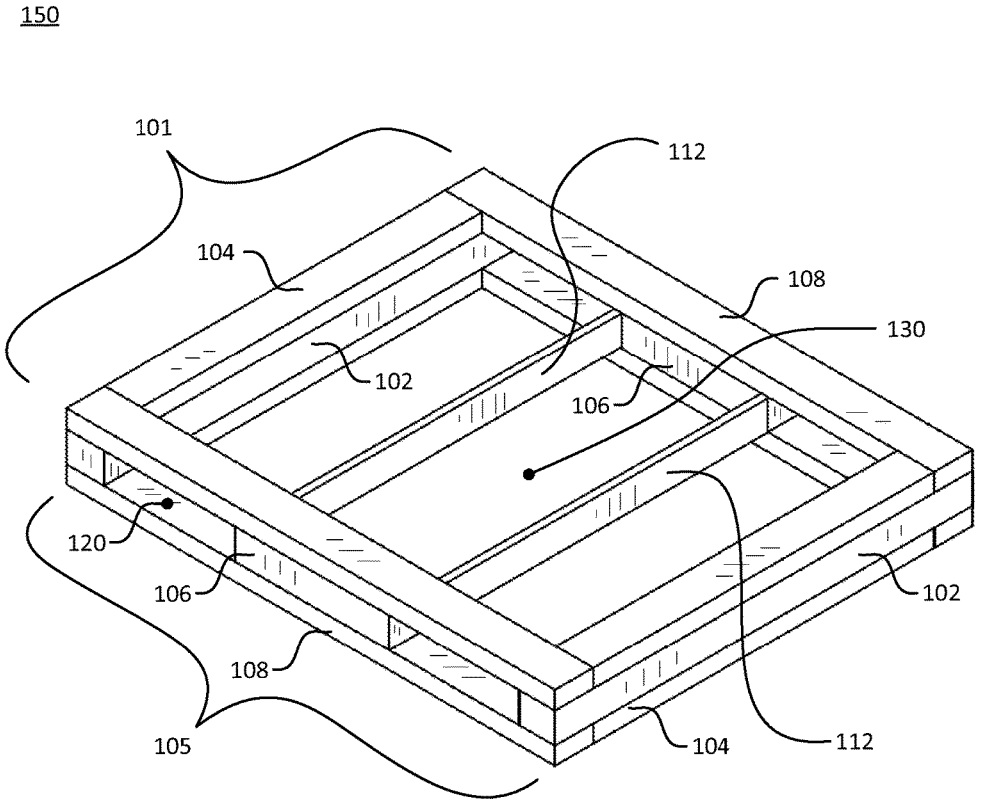
FIG. 3 illustrates a perspective view of a frame of a reconfigurable pallet in a shipping configuration, in accordance with various aspects of the subject technology.

FIG. 3 illustrates a perspective view of the frame 150 of the reconfigurable pallet 100 in a shipping configuration, in accordance with various aspects of the subject technology. In one aspect, the second interlocking members 105 may comprise openings 120 for forks of a fork lift or other machinery that may be used to move or otherwise manipulate the pallet 100. As shown in FIG. 3, when assembled, the ends of interlocking members 101, 105 cooperate with one another to form a quadrilateral arrangement having side walls, a top surface, and a bottom surface. Disposed near the middle or center of the frame 150, is a cavity or compartment 130 formed from internal longitudinal members 112 and interlocking members 105. More specifically, the cavity or compartment 130 utilizes sides formed from the internal longitudinal members 112, structural members 106, and outer members 108. The top and bottom of the cavity or compartment 130 are formed from longitudinal members 110, as shown in FIGS. 4 and 5.

Figure 4:
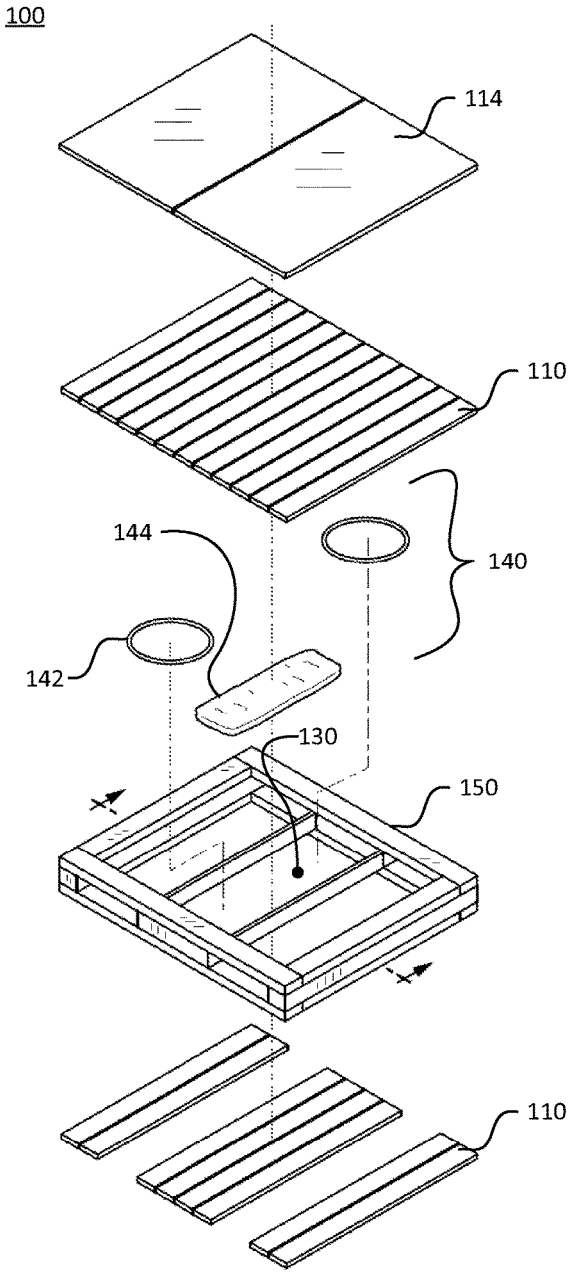
FIG. 4 illustrates an exploded perspective view of a reconfigurable pallet in a shipping configuration, in accordance with various aspects of the subject technology.
Figure 5:
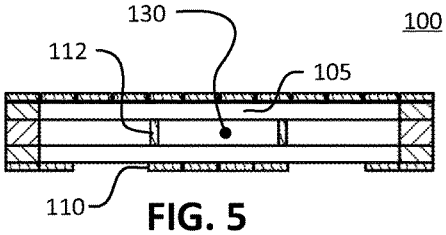
FIG. 5 illustrates a cross section of a reconfigurable pallet in a shipping configuration, in accordance with various aspects of the subject technology.

FIG. 4 illustrates an exploded perspective view of the reconfigurable pallet 100 in a shipping configuration, in accordance with various aspects of the subject technology. The reconfigurable pallet 100 comprises outer panels 114, a plurality of longitudinal members 110, and frame 150.

In some aspects, the plurality of longitudinal members 110 may be disposed on the top and bottom surfaces of the frame 150. For example, on the top surface of the frame 150, twelve longitudinal members 110 may be arranged in a linear array to cover the top surface of the frame 150. On the bottom surface of the frame 150, eight longitudinal members 110 may be arranged in an array to cover a portion of the bottom surface of the frame 150. In one aspect, each longitudinal member 110 of the plurality of longitudinal members 110 may have a length substantially equal to the width or length of the reconfigurable pallet 100.

The longitudinal members 110 may comprise may comprise dimensional lumber having a nominal cross section or a thickness and width of about 1 inch by 4 inches. It is understood that the longitudinal members 110 may be manufactured from wood, composite, polymer, combination thereof, or other materials as would be known by a person of ordinary skill.

In some aspects, the outer panels 114 may be mounted to the longitudinal members 110 disposed on the top surface of the frame 150. For example, the outer panels 114 may comprise a pair of outer panels 114 disposed on the top-most layer of the reconfigurable pallet 100. In one aspect, each outer panel 114 may have a design printed or painted on an outer surface for use when the reconfigurable pallet 100 is converted to a different use and/or purpose. In another aspect, the outer panels 114 may be further painted and marked to facilitate conversion into sporting equipment, as discussed further below. For example, each outer panel 114 may have a basketball backboard design printed on the outer surface that enables the outer panel 114 to be utilized and repurposed as a basketball backboard.

The outer panels 114 may comprise 5-ply plywood sheets, having a combined rough length and width dimension of about 48 inches by 40 inches. It is understood that the outer panels 114 may be manufactured from wood, composite, polymer, combination thereof, or other materials as would be known by a person of ordinary skill.

As shown in FIG. 4, the reconfigurable pallet 100 includes a substantially enclosed cavity or compartment 130 for housing components 140, such as hardware, tools, instructions, sporting equipment, nets, cords, spikes, basketball rims 142, or other components that may be used to reconfigure the pallet for a different purpose and/or use. For example, the compartment 130 may be formed within the reconfigurable pallet 100 by use of longitudinal members 110, internal longitudinal members 112, and frame 150. In one aspect, the compartment 130 may be configured to stow a storage container 144. The storage container 144 may comprise a flexible pouch that is configured to be disposed within the compartment 130 and store hardware, tools, instructions, sporting equipment, or other small components that may be used to reconfigure the pallet for a different purpose and/or use.

FIG. 5 illustrates a cross section of the reconfigurable pallet 100 in a shipping configuration, in accordance with various aspects of the subject technology. As shown in FIG. 5, the compartment 130 comprises a six-sided enclosure that is formed from internal longitudinal members 112, longitudinal members 110, and interlocking members 105. The top and bottom surfaces of the cavity or compartment 130 are formed from longitudinal members 110. The front and rear surfaces of the cavity or compartment 130 are formed from the interlocking members 105. The left and right surfaces of cavity or compartment 130 are formed from the internal longitudinal members 112. In one aspect, the cavity or compartment 130 may be used to safely house components 140 such as the storage container 144, pry bar, tools, hammer, sand bags, instructions, rule sheets, basketball rims 142, wheels, nets, balls, pumps, and a host of objects that may be required to facilitate use of the reconfigurable pallet 100 in its converted or transformed state.

Figure 6:
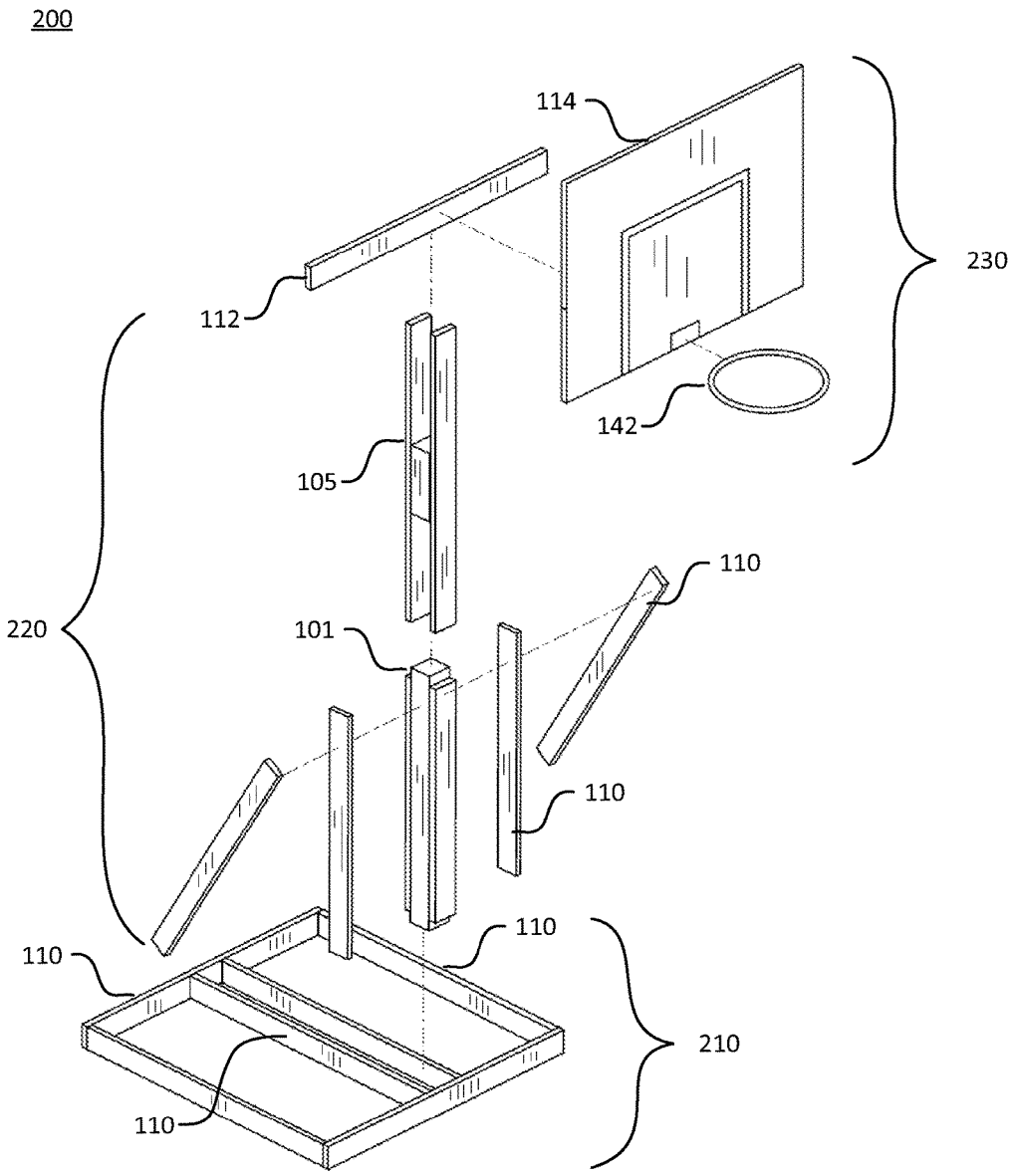
FIG. 6 illustrates an exploded perspective view of a reconfigurable pallet in a basketball assembly configuration, in accordance with various aspects of the subject technology.

FIG. 6 illustrates an exploded perspective view of the reconfigurable pallet in a basketball assembly 200 configuration, in accordance with various aspects of the subject technology. As shown, the reconfigurable pallet 100 may be reconfigured, transformed, or otherwise converted into a basketball assembly 200 with a pole 220, support base 210, and backboard assembly 230. For example, the reconfigurable pallet 100 may be deconstructed and reconstructed or assembled to create two basketball assemblies 200, with each basketball assembly 200 providing a basketball backboard, basketball rim, and basketball net. In one aspect, the reconfigurable pallet 100 may be converted to a different use or purpose by using only the materials and equipment originally used by and contained within the reconfigurable pallet 100 in the shipping configuration.

Referring to FIG. 6, when in the basketball assembly 200, the longitudinal members 110 may be arranged and assembled to create the support base 210. The support base is configured to support the pole 220. In one example, the support base 210 may comprise four longitudinal members 110 arranged in a quadrilateral arrangement, with two longitudinal members 110 disposed within the quadrilateral arrangement. In this example, the support base 210 may comprise a total of six longitudinal members 110.

The pole 220 may be constructed from the plurality of interlocking members 101, 105 and further secured through use of the longitudinal members 110. In one example, the first interlocking member 101 may be disposed adjacent to the support base 210 and in between the two longitudinal members 110 disposed within the quadrilateral arrangement. The second interlocking member 105 may be disposed and mounted to an end of the first interlocking member 101. To further secure the first and second interlocking members 101, 105, four longitudinal members 110 may be disposed and affixed to the sides of the first and second interlocking members 101, 105.

The backboard assembly 230 may be constructed from the internal longitudinal member 112, outer panel 114, and rim 142. In one example, one internal longitudinal member 112 may be affixed to an end of the pole 220 and mounted to an outer surface of one outer panel 114. The rim 142 may be mounted directly to the outer panel 114.

In some aspects, components of one reconfigurable pallet 100 may be used to construct two basketball assemblies 200. Specifically, each basketball assembly 200 may use ten longitudinal members 110, one internal longitudinal member 112, one first interlocking member 101, one second interlocking member 105, and one outer panel 114.

Figure 7:
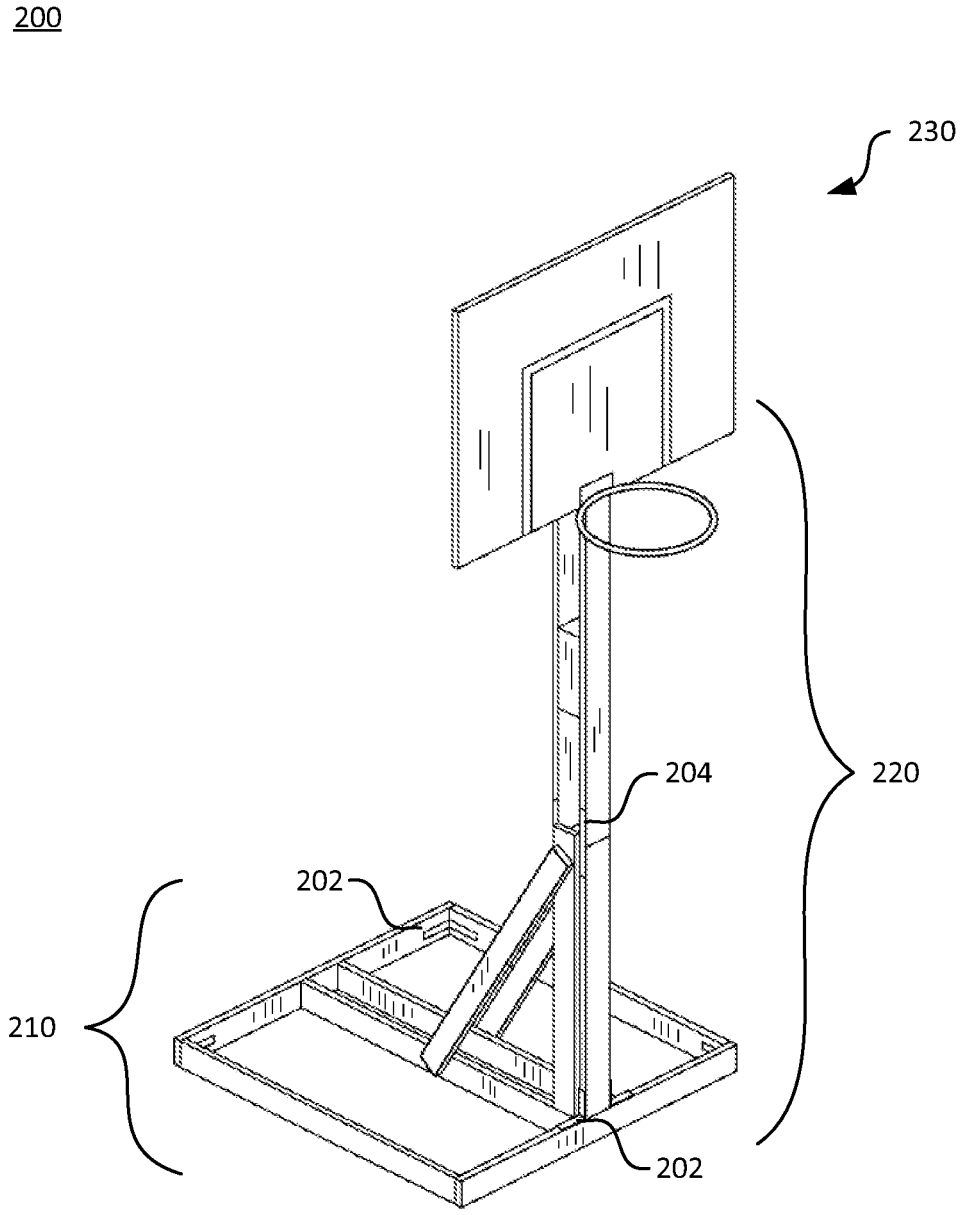
FIG. 7 illustrates a front perspective view of a reconfigurable pallet in a basketball assembly configuration, in accordance with various aspects of the subject technology.
Figure 8:
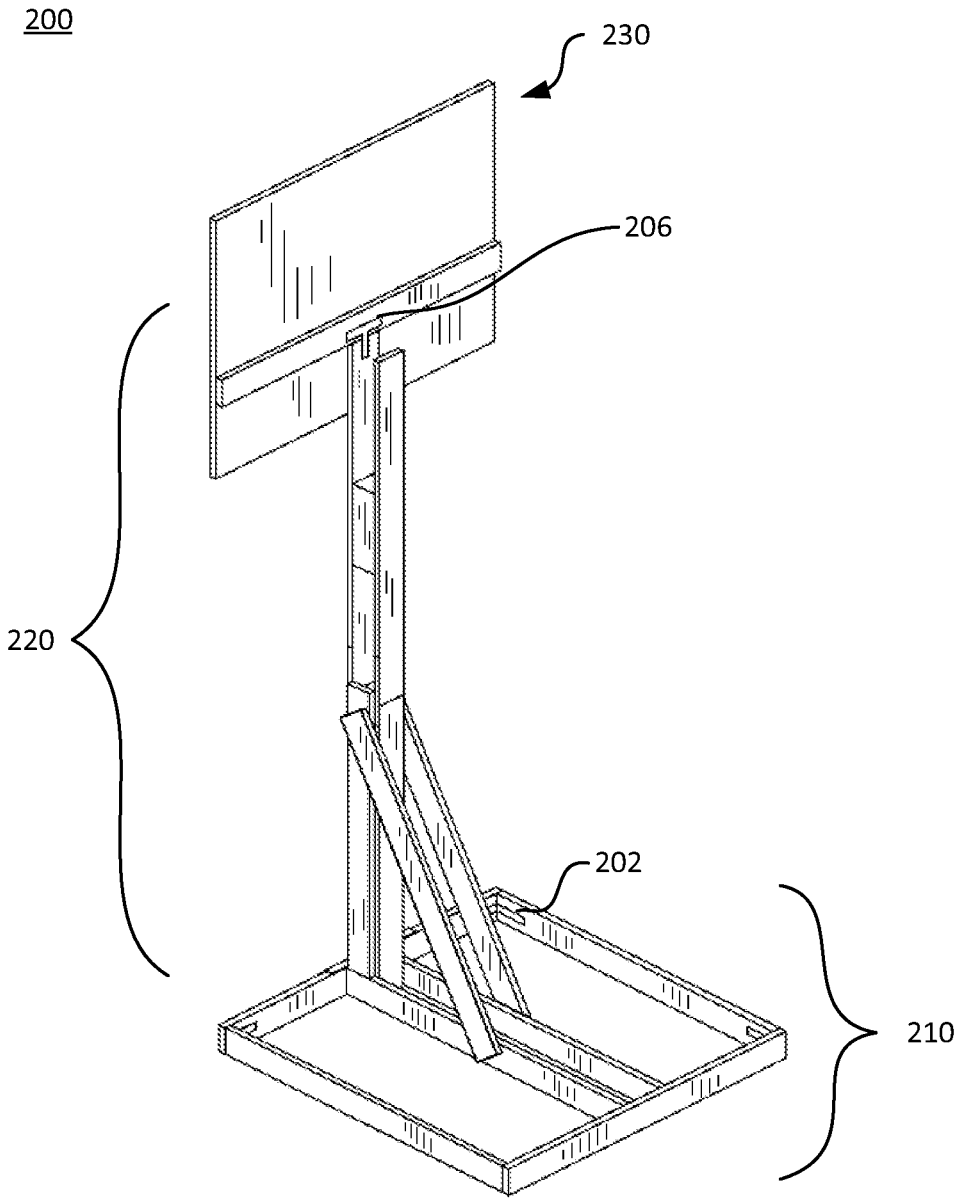
FIG. 8 illustrates a rear perspective view of a reconfigurable pallet in a basketball assembly configuration, in accordance with various aspects of the subject technology.

FIGS. 7 and 8 illustrate front and rear perspective views, respectively, of a reconfigurable pallet in a basketball assembly 200 configuration, in accordance with various aspects of the subject technology. The basketball assembly 200 comprises the support base 210, pole 220 and backboard assembly 230. To further strengthen the basketball assembly, brackets or braces 202, 204, 206 may be included within the compartment 130 (shown in FIGS. 4-5) to strengthen certain aspects of the basketball assembly 200. For example, corner brackets 202 may be used along corners of the support base 210 to strengthen the connections between the longitudinal members 110. Corner brackets may also be used between the support base 210 and pole 220. Strip braces 204 may be used to connect the interlocking members 101, 105 together. A tee bracket 206 may be used to connect the backboard assembly 230 to the pole 220.

Figure 9:
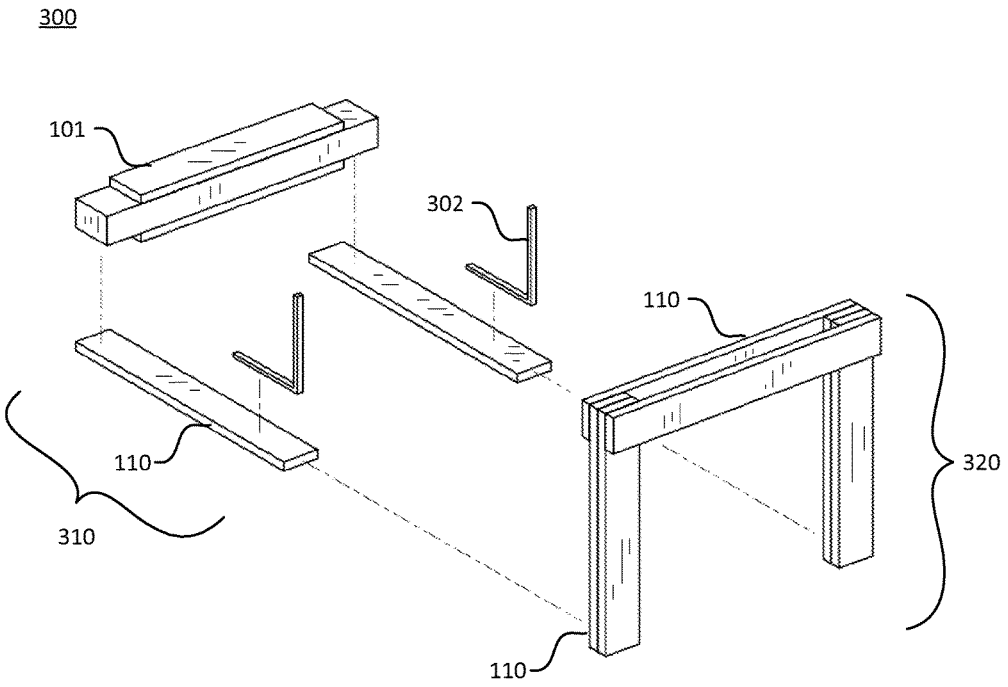
FIG. 9 illustrates an exploded perspective view of a reconfigurable pallet in a soccer assembly configuration, in accordance with various aspects of the subject technology.
Figure 10:
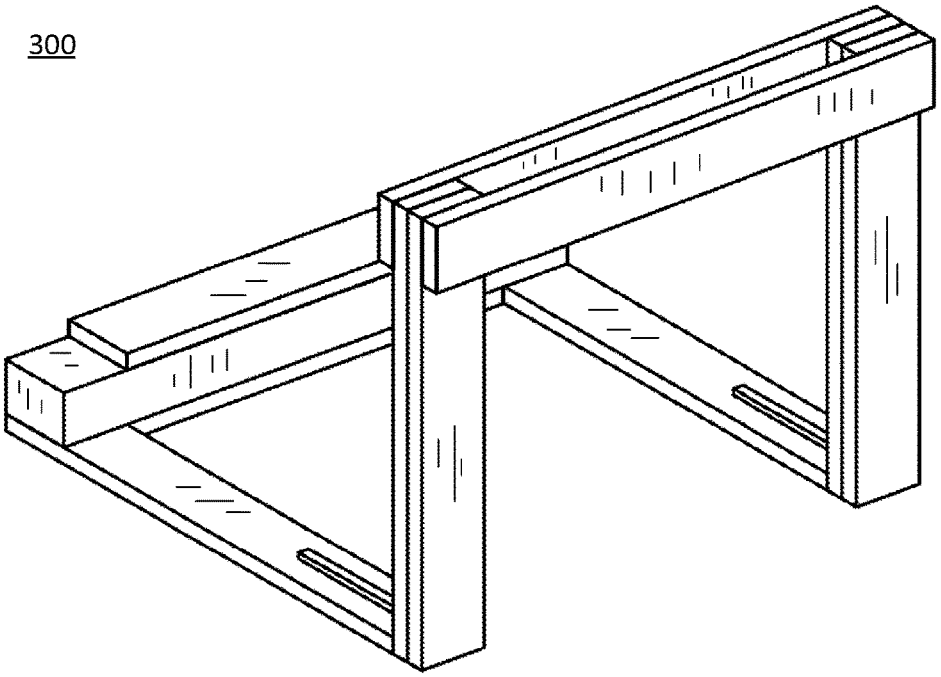
FIG. 10 illustrates a perspective view of a reconfigurable pallet in a soccer assembly configuration, in accordance with various aspects of the subject technology.

FIGS. 9 and 10 illustrate exploded and perspective views, respectively, of a reconfigurable pallet in a soccer assembly 300 configuration, in accordance with various aspects of the subject technology. As shown, the reconfigurable pallet 100 may be reconfigured, transformed, or otherwise converted into a soccer assembly 300 with a support base 310 and goal post 320. For example, the reconfigurable pallet 100 may be deconstructed and reconstructed or assembled to create two soccer goal assemblies 300. In one aspect, the reconfigurable pallet 100 may be converted to a different use or purpose by using only the materials and equipment originally used by or contained within the reconfigurable pallet 100 in the shipping configuration.

When in the soccer assembly 300, first interlocking member 101 and longitudinal members 110 may be arranged and assembled to create the support base 310. The support base is configured to support goal post 320. In one example, the support base 310 may comprise two longitudinal members 110 extending from ends of the first interlocking member 101.

The goal post 320 may be constructed from the longitudinal members 110. In one example, two longitudinal members 110 may be disposed on top of one another to form a first side of the goal post 320. A second side of the goal post 320 may be similarly formed by using two longitudinal members 110. A cross bar may be formed by spanning two longitudinal members 110 across ends of the first and second sides of the goal post 320. In this example, a total of six longitudinal members 110 may be used to form the goal post 320. The goal post 320 may be affixed or attached to the support base 310 via the use of two corner braces 302.

In some aspects, components of one reconfigurable pallet 100 may be used to construct two soccer assemblies 300. Specifically, each soccer assembly 300 may use eight longitudinal members 110 and one first interlocking member 101.

According to various aspects of the subject technology, the reconfigurable pallet 100 may be reconfigured into various uses or equipment without requiring external materials, tools, or equipment. In one aspect, the reconfigurable pallet 100 may be reconfigured for use as sporting equipment without added expense or reduction in shipping capacity because all components necessary for converting the reconfigurable pallet 100 are included within the reconfigurable pallet 100 itself, when the reconfigurable pallet 100 is in its shipping configuration. As described above, all components, tools, instructions, and equipment are included within the compartment 130 (as shown in FIGS. 4-5) of the reconfigurable pallet 100.

Figure 11:
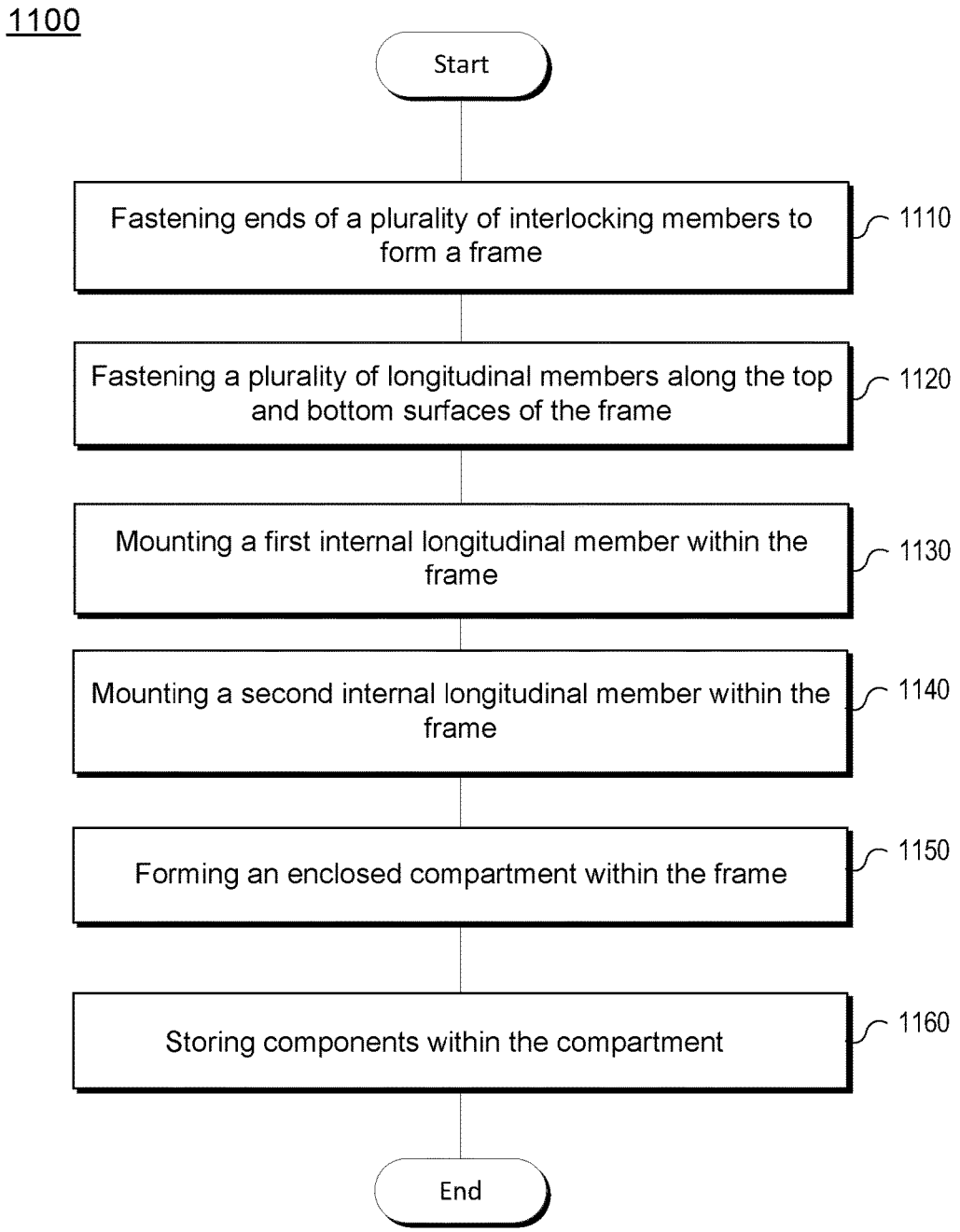
FIG. 11 illustrates an example method for converting a reconfigurable pallet from a shipping configuration to a transformed configuration, in accordance with various aspects of the subject technology.

FIG. 11 illustrates an example method 1100 for assembling a reconfigurable pallet, in accordance with various aspects of the subject technology. It should be understood that, for any process discussed herein, there can be additional, fewer, or alternative steps performed in similar or alternative orders, or in parallel, within the scope of the various embodiments unless otherwise stated.

At operation 1110, ends of a plurality of interlocking members are fastened to form a frame. The frame may comprise side walls, a top surface, and a bottom surface. At operation 1120, a plurality of longitudinal members are fastened along the top and bottom surfaces of the frame. At operation 1130, a first internal longitudinal member is mounted within the frame. The first internal longitudinal member may span across the side walls of the frame. At operation 1140, a second internal longitudinal member is mounted within the frame. The second internal longitudinal member may span across the side walls of the frame and may be positioned in parallel with the first internal longitudinal member. At operation 1150, an enclosed compartment is formed within the frame. The compartment may be formed from at least one interlocking member of the plurality of interlocking members, at least one longitudinal member of the plurality of longitudinal members, the first internal longitudinal member, and the second internal longitudinal member. At operation 1160, components are stored within the compartment. The components stored within the compartment may comprise tools, sporting equipment such as a ball, hoop, or net, instructions, or other components necessary for converting the reconfigurable pallet to a different use, function or purpose. In one aspect, the components stored within the compartment may be placed within a separate storage container that is itself stored within the compartment. The method 1100 may further comprise attaching a panel on the plurality of longitudinal members arranged along the top surface of the frame. In other aspects, the plurality of interlocking members, the plurality of longitudinal members, the first internal longitudinal member, and the second internal longitudinal member may each comprise dimensional lumber.

Figure 12:
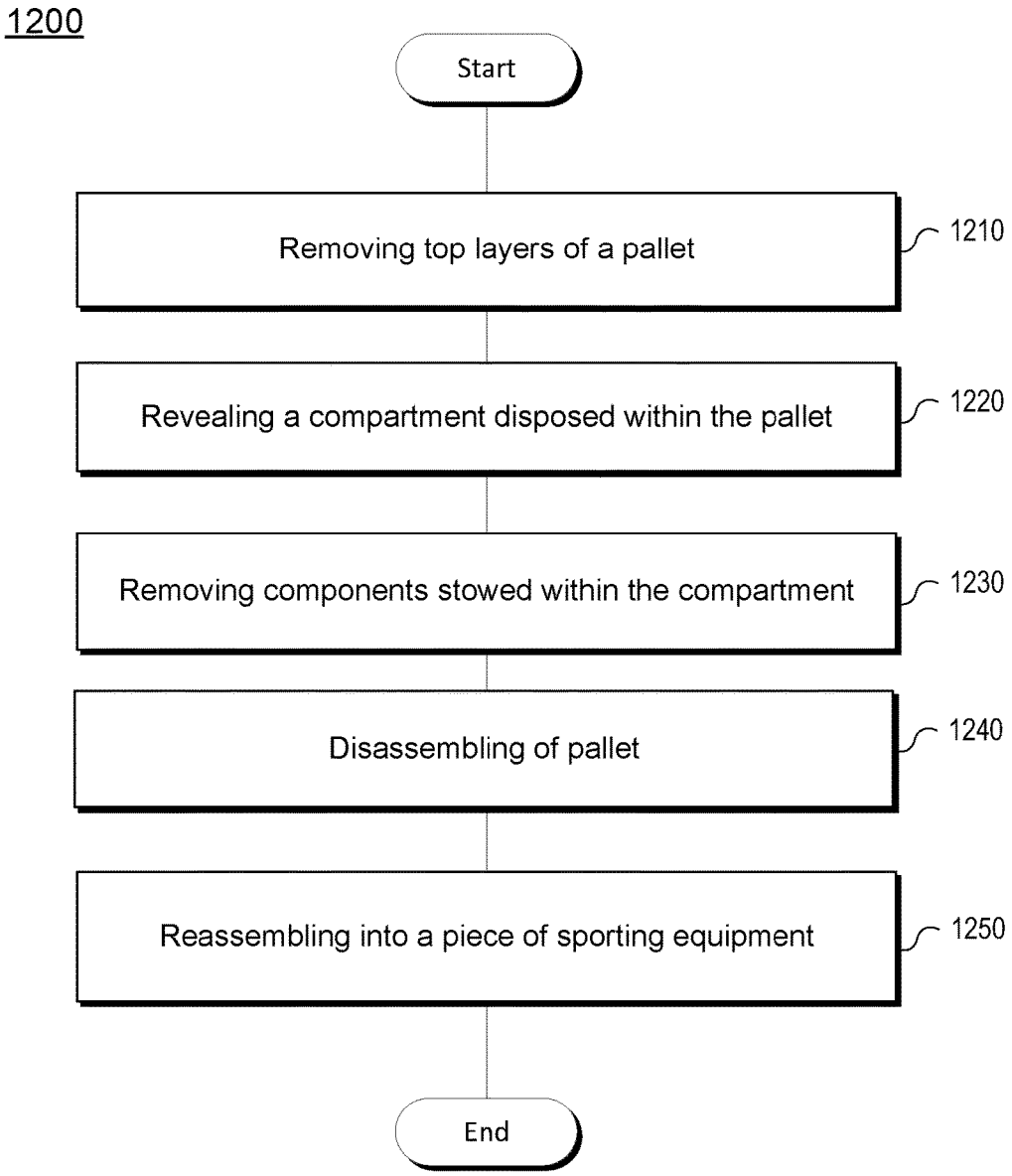
FIG. 12 illustrates an example method for converting a reconfigurable pallet from a shipping configuration to a transformed configuration, in accordance with various aspects of the subject technology.

FIG. 12 illustrates an example method 1200 for converting a reconfigurable pallet from a shipping configuration to a transformed configuration, in accordance with various aspects of the subject technology. It should be understood that, for any process discussed herein, there can be additional, fewer, or alternative steps performed in similar or alternative orders, or in parallel, within the scope of the various embodiments unless otherwise stated.

At operation 1210, top layers of a pallet configured in a shipping configuration are removed. At operation 1220, a compartment disposed within the pallet is revealed. At operation 1230, components are removed from the compartment. The components may comprise tools, sporting equipment such as a ball, hoop, or net, instructions, or other components necessary for converting the pallet to a different use, function or purpose. At operation 1240, the pallet is disassembled. At operation 1250, the pallet is reassembled into a piece of sporting equipment using only the components stored within the compartment.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A pallet, comprising:

a plurality of interlocking members disposed around a periphery to form a frame, the frame comprising side walls, a top surface, and a bottom surface;

a plurality of longitudinal members arranged along the top and bottom surfaces of the frame;

a first internal longitudinal member disposed within the frame and extending across the side walls of the frame;

a second internal longitudinal member disposed within the frame and parallel to the first internal longitudinal member;

an enclosed compartment disposed within the frame, the compartment formed from at least one interlocking member of the plurality of interlocking members, at least one longitudinal member of the plurality of longitudinal members, the first internal longitudinal member, and the second internal longitudinal member; and a storage container disposed within the compartment.

2. The pallet of claim 1, further comprising a panel disposed on the plurality of longitudinal members arranged along the top surface of the frame.

3. The pallet of claim 2, wherein the panel comprises plywood.

4. The pallet of claim 1, further comprising a plurality of openings formed within the frame, the plurality of openings configured to receive ends of a fork lift.

5. The pallet of claim 1, wherein each interlocking member of the plurality of the interlocking members comprises a first dimensional lumber having a nominal cross-section of 1 inch×4 inch and a second dimensional lumber having a nominal cross-section of 4 inch×4 inch.

6. The pallet of claim 1, wherein each longitudinal member of the plurality of the longitudinal members comprises dimensional lumber having a nominal cross-section of 1 inch×4 inch.

7. The pallet of claim 1, wherein the first and second internal longitudinal members each comprise dimensional lumber having a nominal cross-section of 1 inch by 4 inch.

8. The pallet of claim 1, further comprising at least one of a ball, hoop, and net, wherein the at least one of a ball, hoop, and net is disposed within the storage container.

9. A method for assembling a reconfigurable pallet, the method comprising:

fastening ends of a plurality of interlocking members to form a frame, the frame comprising side walls, a top surface, and a bottom surface;

fastening a plurality of longitudinal members along the top and bottom surfaces of the frame;

mounting a first internal longitudinal member within the frame, the first internal longitudinal member spanning across the side walls of the frame;

mounting a second internal longitudinal member within the frame, the second internal longitudinal member spanning across the side walls of the frame and positioned in parallel with the first internal longitudinal member;

forming an enclosed compartment within the frame, wherein the compartment is formed from at least one interlocking member of the plurality of interlocking members, at least one longitudinal member of the plurality of longitudinal members, the first internal longitudinal member, and the second internal longitudinal member; and storing components within the compartment.

10. The method of claim 9, further comprising attaching a panel on the plurality of longitudinal members arranged along the top surface of the frame.

11. The method of claim 9, wherein the components stored within the compartment comprise at least one of a ball, hoop, and net.

12. The method of claim 9, wherein the plurality of interlocking members, the plurality of longitudinal members, the first internal longitudinal member, and the second internal longitudinal member each comprise dimensional lumber.

13. A reconfigurable pallet, comprising:

a plurality of interlocking members; and wherein when in a shipping configuration, the plurality of interlocking members are disposed around a periphery to form a frame, the frame comprising side walls, a top surface, and a bottom surface; and wherein when in a transformed configuration, at least one interlocking member of the plurality of interlocking members is disposed vertically to create a pole;

a plurality of longitudinal members;

wherein when in the shipping configuration, the plurality of longitudinal members are arranged along the side walls, top surface, and bottom surface of the frame to form an enclosed compartment within the frame, wherein the compartment is configured to store components; and wherein when in the transformed configuration, at least one longitudinal member of the plurality of longitudinal members is configured to support the at least one interlocking member of the plurality of interlocking members.

14. The reconfigurable pallet of claim 13, further comprising a panel;

wherein when in the shipping configuration, the panel is disposed on the plurality of longitudinal members arranged along the top surface of the frame; and wherein when in the transformed configuration, the panel is disposed atop of the pole.

15. The reconfigurable pallet of claim 13, further comprising a storage container disposed within the compartment, wherein the storage container comprises a flexible pouch configured to store the components.

16. The reconfigurable pallet of claim 13, wherein the plurality of interlocking members further comprise a plurality of openings configured to receive ends of a fork lift.

17. The reconfigurable pallet of claim 13, wherein the components stored in the compartment comprise at least one of a ball, hoop, and net.

18. The reconfigurable pallet of claim 13, wherein the plurality of interlocking members and the plurality of longitudinal members each comprise dimensional lumber.

* * * * *